US010822567B2

(12) United States Patent
Puukilainen

(10) Patent No.: US 10,822,567 B2
(45) Date of Patent: Nov. 3, 2020

(54) COMPOSITION FOR IMPROVING PERFORMANCE OF WAXLESS SKIS

(71) Applicant: VAUHTI SPEED OY, Joensuu (FI)

(72) Inventor: Esa Puukilainen, Joensuu (FI)

(73) Assignee: VAUHTI SPEED OY, Joensuu (FI)

( * ) Notice: Subject to any disclaimer, the term of this patent is extended or adjusted under 35 U.S.C. 154(b) by 0 days.

(21) Appl. No.: 15/999,834

(22) PCT Filed: Feb. 16, 2017

(86) PCT No.: PCT/FI2017/050096

§ 371 (c)(1),
(2) Date: Aug. 20, 2018

(87) PCT Pub. No.: WO2017/140952

PCT Pub. Date: Aug. 24, 2017

(65) Prior Publication Data

US 2019/0194565 A1 Jun. 27, 2019

(30) Foreign Application Priority Data

Feb. 18, 2016 (FI) ..... 20165123

(51) Int. Cl.

| | |
|---|---|
| ***C10M 107/38*** | (2006.01) |
| ***C10M 107/50*** | (2006.01) |
| ***C10M 129/06*** | (2006.01) |
| ***C10M 111/04*** | (2006.01) |
| ***A63C 7/02*** | (2006.01) |
| ***C10M 105/12*** | (2006.01) |
| ***C10M 105/80*** | (2006.01) |
| ***C10M 105/76*** | (2006.01) |
| *C10N 20/04* | (2006.01) |

(52) U.S. Cl.

CPC ..... *C10M 107/38* (2013.01); *A63C 7/02* (2013.01); *C10M 105/12* (2013.01); *C10M 105/76* (2013.01); *C10M 105/80* (2013.01); *C10M 107/50* (2013.01); *C10M 111/04* (2013.01); *C10M 129/06* (2013.01); *C10M 2207/021* (2013.01); *C10M 2207/0215* (2013.01); *C10M 2213/046* (2013.01); *C10M 2213/0606* (2013.01); *C10M 2229/0415* (2013.01); *C10M 2229/0515* (2013.01); *C10N 2020/04* (2013.01)

(58) Field of Classification Search

CPC combination set(s) only.
See application file for complete search history.

(56) References Cited

U.S. PATENT DOCUMENTS

| | | | | |
|---|---|---|---|---|
| 5,571,780 | A * | 11/1996 | Silvani | C10M 107/38 508/582 |
| 5,624,713 | A | 4/1997 | Ramer | |
| 6,114,448 | A | 9/2000 | Derbes | |
| 2003/0021054 | A1* | 1/2003 | Feliss | G11B 33/148 360/69 |
| 2005/0090408 | A1 | 4/2005 | Burns | |
| 2007/0225179 | A1* | 9/2007 | Schutz | C09G 3/00 508/207 |
| 2011/0015420 | A1* | 1/2011 | Yamaguchi | C08G 77/46 556/419 |

FOREIGN PATENT DOCUMENTS

| | | |
|---|---|---|
| CN | 103525575 | 1/2014 |
| CN | 103865390 | 6/2014 |
| CN | 104877564 | 9/2015 |
| CN | 105063624 | 11/2015 |
| DE | 199 01 973 | 8/2000 |
| DE | 10 2008 012 8 | 9/2009 |
| EP | 0 778 337 | 6/1997 |
| EP | 1 029 905 | 8/2000 |
| JP | 2009-019189 | 1/2009 |

OTHER PUBLICATIONS

International Search Report for PCT/FI2017/050096, dated May 26, 2017, 4 pages.
International Preliminary Report on Patentability for PCT/FI2017/050096, dated May 9, 2018, 12 pages.
Search Report for FI 20165123, dated Sep. 19, 2016, 2 pages.

* cited by examiner

*Primary Examiner* — Prem C Singh
*Assistant Examiner* — Chantel L Graham
(74) *Attorney, Agent, or Firm* — Nixon & Vanderhye P.C.

(57) ABSTRACT

Provided herein is a composition for improving performance of waxless skis, in particular skin skis, more particularly of skin strips, on snow, the composition com¬prising (a) $C_{1-6}$-alcohol(s); and (b) lubricant(s) selected from a group consisting of (c) perfluoropolyethers, (d) polydi($C_{1-3}$-alkyl) siloxanes, and mixtures thereof.

17 Claims, No Drawings

COMPOSITION FOR IMPROVING PERFORMANCE OF WAXLESS SKIS

This application is the U.S. national phase of International Application No. PCT/FI2017/050096 filed 16 Feb. 2017, which designated the U.S. and claims priority to FI Patent Application No. 20165123 filed 18 Feb. 2016, the entire contents of each of which are hereby incorporated by reference.

FIELD OF THE INVENTION

The present invention relates to a composition for improving performance of waxless skis, in particular skin skis, and more particularly to a composition substantially free of any aliphatic and/or aromatic hydrocarbons for improving performance of skin strips on snow.

BACKGROUND OF THE INVENTION

Waxless skis are skis wherein grip of the ski base to snow is provided by means other than applying a composition typically referred to as kick or grip wax to the kick zone of the skis. One example of providing grip to waxless skis is skin strips. Skin strips, also referred to as climbing skins or ski skins, are strips that attach to the bottom of Nordic and Alpine skis to provide grip. To provide waxless skis skin strips are typically attached to the kick zone of the skis with an adhesive on the ski base thus providing skin skis. They are called skins because they resemble sealskin and are designed to let the ski slide forward on snow but not backward and to provide solid grip. They are typically made from mohair or nylon or a combination thereof. They may also be coated with e.g. teflon.

The surface of the bases of waxless skis, in particular the skin strip surface of skin skis, should be conditioned periodically to provide adequate performance, such as gliding performance on snow and grip abilities, of the waxless skis. Typical liquid compositions marketed for conditioning of ski bases contain aliphatic hydrocarbon solvents such as heptane. Compositions based on aliphatic and/or aromatic unfortunately dissolve the adhesive attaching the skin strips to the ski base and when employed for cleaning skin strips lead to detachment of the skin strips from the ski base. This naturally leads to the damage of the skin ski.

DE 102008012895 discloses a corrosion protective gel and coating comprising the gel for electronic or micromechanical components.

CN 104877564 discloses a super hydrophobic grease composition.

CN 105063624 discloses a hub anti-rust agent.

CN 103865390 discloses a hydrophobic coating solution for preparation of anti-fouling anti-fingerprint coating.

CN 103525575 discloses a composition used for cleaning printing circuit board.

U.S. Pat. No. 5,624,713 discloses a composition for improving the lubricity of a snow ski having sintered base.

JP 2009019189 discloses a wax used for edge portion of ski-board, snowboard, snowscoot and skating board.

EP 1029905 discloses a liquid fluorinated ski wax.

DE 19901973 discloses a coating for skis and snowboards.

BRIEF DESCRIPTION OF THE INVENTION

An object of the present invention is thus to provide a composition for improving performance, in particular gliding performance, of waxless skis, in particular skin skis, and more particularly for improving performance, such as gliding performance on snow and/or grip, of skin strips, so as to overcome the above problems. The objects of the invention are achieved by a composition, use thereof and a method, which are characterized by what is stated in the independent claims. The preferred embodiments of the invention are disclosed in the dependent claims.

The invention is based on the realization that a composition comprising (a) alcohol(s) and (b) lubricant(s) selected from a group consisting of (b1) polydi($C_{1-3}$-alkyl)siloxanes, (b2) perfluoropolyethers and mixtures thereof and is substantially free of any aliphatic and aromatic hydrocarbon solvents avoids detachment of the skin strips from the ski base but improves performance of the skin strips and thus the performance of the skin skis. The present composition also improves the performance of other waxless skis on snow.

DETAILED DESCRIPTION OF THE INVENTION

Provided herein is a composition comprising (a) $C_{1-6}$-alcohol;

(b) lubricant(s) selected from a group consisting of (c) perfluoropolyethers, (d) polydi($C_{1-3}$-alkyl)siloxanes, and mixtures thereof.

Further provided herein is a use of a composition comprising (a) $C_{1-6}$-alcohol;

(b) lubricant(s) selected from a group consisting of (c) perfluoropolyethers, (d) polydi($C_{1-3}$-alkyl)siloxanes, and mixtures thereof;

for improving performance of waxless skis, in particular skin skis, and/or for improving performance of skin strips. The composition in particular improves the gliding performance of the waxless skis on snow, and further also the grip abilities of the waxless skis.

The term "waxless ski" refers to skis, in particular to Nordic skis, wherein grip of the ski base to snow is provided in the absence of a composition for providing grip, such as a kick or grip wax composition, applied to the kick zone of the said skis.

The term "skin strip" refers to strips that may be attached to the bottom of Nordic or Alpine skis to provide grip, in particularly to strips attached to the kick zone of the skis with an adhesive on the ski base. The said skin strips are preferably comprised from nylon or mohair or a combination thereof. They may also be coated with e.g. teflon. As follows, the term "skin ski" refers to skis, in particular Nordic or Alpine skis, comprising skin strips on the ski base, in wherein the skin strip is attached to the kick zone of skis with an adhesive.

The term "improving performance" refers to improved or enhanced gliding performance of the skis treated with the present composition in comparison to the same skis neither treated with the present composition nor with any other composition that is intended for improving performance of the. The term "improving gliding performance on snow" refers to improved or enhanced gliding performance of the skis treated with the present composition in comparison to the same skis neither treated with the present composition nor with any other composition that is intended for improving gliding performance of the skis on snow. The term "improving grip" refers to improved or enhanced grip of the skis treated with the present composition in comparison to the same skis neither treated with the present composition nor with any other composition that is intended for improving grip of the skis on snow.

The term "comprise" as used herein and hereafter describes the constituents of the present composition in a non-limiting manner i.e. the present composition comprising defined constituents consists, at least, of the said constituents, but may additionally, when desired, comprise other constituents. However, the present composition comprising defined constituents may consist of only the said constituents. The term "comprise" is further used to reflect that the present composition may comprise trace amounts of other materials or impurities, or both, which do not alter the effectiveness of the present composition.

The present composition improves the performance of waxless skis, in particular of skin skis, by reducing build-up of impurities from the ski tracks to the ski bases and/or the skin strips attached to the ski bases, respectively, and/or preventing icing of the ski bases and/or skin strips attached to the ski bases, respectively, thus maintaining and improving the performance of the waxless skis, in particular the skin strips. The present composition in particular maintains and improves the gliding performance of the waxless on snow. Preferably the present composition maintains and improves both the gliding performance and the grip of the waxless skis on snow.

The present composition, in particular when intended for use in connection of skin skis, preferably does not comprise aliphatic and aromatic hydrocarbon solvents as their presence in even small amounts could lead to detachment of the skin strip from the base of the ski.

The present composition comprises (a) $C_{1-6}$-alcohol(s), preferably $C_{2-4}$-alcohol(s) as a solvent. The term "$C_{1-6}$-alcohol" refers to alcohols comprising a $C_{1-6}$-alkyl group and a OH-group attached to the alkyl group. The $C_1$-$C_6$-alkyl group of the $C_{1-6}$-alcohol may be linear or branched. Examples of $C_{1-6}$-alcohol(s) include methanol, ethanol, n-propanol, i-propanol, n-butanol, i-butanol, t-butanol, pentanol, hexanol, etc. Preferably (a) the $C_{1-6}$-alcohol(s) are selected from a group consisting of ethanol, propanol, and any mixtures thereof.

The above described (a) $C_{1-6}$-alcohol(s) are typically present in the composition in an amount of at least 30% by weight, preferably from 35 to 70% by weight, of the total weight of the composition. The amount of (a) is dependent of the amount of the other components in the present composition. Most preferably the amount of (a) is from 40 to 60% by weight of the total weight of the composition.

In addition to (a) alcohol(s) the present composition also comprises (b) lubricant(s) selected from a group consisting of (c) perfluoropolyethers, (d) polydi($C_{1-3}$-alkyl)siloxanes, and mixtures thereof. These lubricants (b) are present in the composition typically in an amount of at least 1% by weight of the total weight of the composition.

Preferably the present composition comprises at least 1% by weight, more preferably at least 4% by weight, even more preferably at least 8% by weight, the total weight of the composition of (c) perfluoropolyethers. Perfluoropolyethers (c) provide low coefficient of friction and improved dirt resistivity and hydrophobicity to the skin strip material.

Preferably at least some of the perfluoropolyethers (c) are non-volatile perfluoropolyethers (c1) having an average molecular weight (MW) from 1500 to 3500 g/mol. The amount of non-volatile perfluoropolyethers (c1) is advantageously at least 0.5% by weight, more preferably at least 0.75% by weight, even more preferably at least 1% by weight, the total weight of the composition.

Advantageously the said perfluoropolyethers (c) consist of (c1) non-volatile perfluoropolyethers having an average molecular weight (MW) from 1500 to 3500 g/mol; and (c2) volatile perfluoropolyethers having an average molecular weight (MW) from 300 to 700 g/mol. When both volatile and non-volatile perfluoropolyethers are present in the present composition the ratio of non-volatile perfluoropolyethers (c1) to volatile perfluoropolyethers (c2) is typically from 1:1 to 1:10, preferably the ratio of (c1) to (c2) is from 1:4 to 1:8. This minimizes the required amount of expensive non-volatile perfluoropolyethers (c1) without compromising the properties of the present composition. With the help of the volatile mobile small molecular weight perfluoropolyethers the non-volatile perfluoropolyethers can be transferred more easily to the surface of the ski base, in particular the surface of the skin strip.

The amount of non-volatile perfluoropolyethers (c1) is advantageously at least 0.5% by weight, more preferably at least 0.75% by weight, even more preferably at least 1% by weight, of the total weight of the composition.

The amount of volatile perfluoropolyethers (c2) is advantageously at least 0.5% by weight, more preferably at least 2% by weight, even more preferably at least 5% by weight, most preferably at least 8% by weight, of the total weight of the composition.

Typically the present non-volatile perfluoropolyethers (c1) have a general formula (I)

$$CF_3O[CF_2(CF_3)CFO)_m—(CF_2O)_n—R^1 \quad (I)$$

wherein m+n is from 8 to 25, more preferably from 10 to 20, and $R^1$ is selected from the group consisting of $CF_3$, $C_2F_5$ and $C_3F_7$.

Examples of suitable non-volatile perfluoropolyethers (c1) include, but are not limited to, perfluoropolyethers having an average molecular weight selected from 1800 g/mol, 2500 g/mol, 2700 g/mol and 3300 g/mol. Non-volatile perfluoropolyethers are commercially available for example under the trade name Fomblin Y. For example, the non-volatile perfluoropolyethers are selected from a group consisting of Fomblin YVAC L 06/6, Fomblin YVAC L 14/6, Fomblin YVAC L 16/6, Fomblin YVAC L 25/6, and any mixtures thereof. Most preferably the non-volatile perfluoropolyethers (c1) have an average molecular weight of 1800 g/mol.

Typically the present volatile perfluoropolyethers (c2) have a general formula (II)

$$CF_3O[CF_2(CF_3)CFO)_o—(CF_2O)_p—R^2 \quad (II)$$

wherein o+p is from 1 to 8, preferably from 1 to 6, and $R^2$ is selected from the group consisting of $CF_3$, $C_2F_5$ and $C_3F_7$.

Examples of suitable volatile perfluoropolyethers (c2) include by are not limited to perfluoropolyethers having an average molecular weight selected from 340 g/mol, 410 g/mol, 430 g/mol and 580 g/mol. Volatile perfluoropolyethers are commercially available for example under the trade name Galden HT. For example, the volatile perfluoropolyethers are selected from a group consisting of Galden HT55, Galden HT70, Galden HT80, Galden HT110 and any mixtures thereof. Most preferably the volatile perfluoropolyethers (c2) have an average molecular weight of 340 g/mol.

Further preferably the present composition comprises polydi($C_{1-3}$-alkyl)siloxane(s) (d). The amount of polydi ($C_{1-3}$-alkyl)siloxanes (d) is advantageously at least 10% by weight, preferably at least 20% by weight, more preferably at least 30% by weight, even more preferably at least 40% by weight, the total weight of the composition. The polydi ($C_{1-3}$-alkyl)siloxanes (d) provide low coefficient of friction and improved dirt resistivity and hydrophobicity to the skin strip material.

Typically the present polydi($C_{1-3}$-alkyl)siloxane(s) (d) have a general formula (III)

$$R^3—[Si(R^3)—O—Si(R^3)]_q—R^3 \quad (III)$$

wherein q is from 1 to 15, preferably 1 to 10, more preferably 1 to 5, and each $R^3$ is independently selected from $C_{1-3}$-alkyl, preferably each $R^3$ is methyl.

The polydi($C_{1-3}$-alkyl)siloxane (d) may be hexamethyldisiloxane, or any other polydi($C_{1-3}$-alkyl)siloxane, or the composition may contain a mixture of different polydi ($C_{1-3}$-alkyl)siloxanes.

In an embodiment, polydi($C_{1-5}$-alkyl)siloxanes may be used (in addition to/instead of polydi($C_{1-3}$-alkyl)siloxanes) in the composition.

Most preferably the present composition is a composition comprising (a) $C_{1-6}$-alcohol(s), wherein the $C_{1-6}$-alcohol(s) are preferably selected from a group consisting of ethanol, propanol, and any mixtures thereof;

(c1) at least 0.5% by weight, preferably at least 0.75% by weight, more preferably at least 1% by weight, of the total weight of the composition of non-volatile perfluoropolyethers having an average molecular weight from 1500 to 3500;

(c2) at least 0.5% by weight, preferably at least 2% by weight, more preferably at least 5% by weight, most preferably at least 8% by weight, of the total weight of the composition of volatile perfluoropolyethers having an average molecular weight from 300 to 700; and (d) at least 10% by weight, preferably at least 20% by weight, more preferably at least 30% by weight, even more preferably at least 40% by weight, of the total weight of the composition of polydi($C_{1-3}$-alkyl)siloxanes.

The polydi($C_{1-3}$-alkyl)siloxane (d) may be hexamethyldisiloxane, or any other polydi($C_{1-3}$-alkyl)siloxane, or the composition may contain a mixture of different polydi ($C_{1-3}$-alkyl)siloxanes.

In an embodiment, polydi($C_{1-5}$-alkyl)siloxanes may be used in the composition (in addition to/instead of polydi ($C_{1-3}$-alkyl)siloxanes).

In an embodiment, the amount of polydi($C_{1-5}$-alkyl)siloxanes (d) is from at least 10% by weight to at least 40% by weight, preferably from at least 20% by weight to at least 30% by weight, more preferably about 25% by weight, of the total weight of the composition.

Provided herein is also a method for providing waxless skis, in particular skin skis, with improved performance, in particular with improved gliding performance on snow, comprising applying the present composition to the bases of the skis, in particular to the skin strips attached to the bases of the skis.

The present composition may be used for improving performance of waxless skis, in particular skin skis and/or skin strips, as such. The present composition is obtained by mixing the components of the composition. It may for example be provided in any suitable container, for example a container comprising a sponge for applying the composition from the container directly onto the surface of the base of the ski and/or the surface of the skin strip. When used for improving performance of skin skis, the composition is then preferably spread on the whole surface of the skin strip with the help of the sponge or with a clean cloth until desired amount of the composition has been applied. The present composition may also be provided in a spray bottle to be sprayed on the surface of the bases of the skis and/or of the skin strips. Alternatively the present composition may be provided in a form of a disposable cloth into which the composition has been adsorbed in an amount that is effective for improving performance of the waxless skis, in particular skin strips. The disposable cloth is preferably suitably packed to prevent evaporation of the present composition prior to use.

Further provided herein is a kit for maintenance of waxless skis, in particular skin skis, and/or for maintenance of skin strips, comprising a container or disposable cloth(s) comprising the present composition. When the kit comprises a container comprising the present composition it preferably further comprises a cloth for spreading the composition on the surface of the base of the ski, in particular on the surface of the skin strip. The container comprising the present composition preferably comprises a sponge for applying the present composition from the container directly onto the surface of the base of the ski and/or on to the surface of the skin strip. The present kit may further comprise a second container or second disposable cloth(s) comprising a composition for cleaning bases of waxless skis, in particular for cleaning skin strips.

EXAMPLES

Example 1. Composition 1

45% by weight of ethanol
45% by weight of hexamethyldisiloxane
8.75% by weight of perfluoropolyether, MW 340 g/mol
1.25% by weight of perfluoropolyether, MW 1800 g/mol.

The composition 1 was obtained by mixing the above indicated components.

Example 2. Composition 2

65% by weight of ethanol
25% by weight of polydi($C_{1-3}$-alkyl)siloxanes
8.75% by weight of perfluoropolyether, MW 340 g/mol
1.25% by weight of perfluoropolyether, MW 1800 g/mol.

The composition 2 was obtained by mixing the above indicated components.

It will be obvious to a person skilled in the art that, as the technology advances, the inventive concept can be implemented in various ways. The invention and its embodiments are not limited to the examples described above but may vary within the scope of the claims.

The invention claimed is:

1. A method for improving performance of a waxless ski, the method comprising applying a composition to a base of the waxless ski, the composition containing (a) at least one $C_{1-6}$-alcohol; and (b) at least one lubricant selected from a group consisting of (c) perfluoropolyethers, (d) polydi($C_{1-5}$-alkyl)siloxanes, and mixtures of (c) perfluoropolyethers and (d) polydi ($C_{1-5}$-alkyl)siloxanes, said composition containing at least 1% by weight of the total weight of the composition of (c) perfluoropolyethers.

2. The method of claim 1, wherein said composition contains (c1) non-volatile perfluoropolyethers having an average molecular weight from 1500 to 3500; and (c2) volatile perfluoropolyethers having an average molecular weight from 300 to 700.

3. The method of claim 2, wherein in said composition the weight ratio of (c1) to (c2) is from 1:1 to 1:10.

4. The method of claim 1, wherein in said composition the amount of non-volatile perfluoropolyethers (c1) is at least 0.5% by weight of the total weight of said composition; and the amount of volatile perfluoropolyethers (c2) is at least 0.5% by weight of the total weight of said composition.

5. The method of claim 1, wherein said composition contains at least 10% by weight of the total weight of said composition of polydi($C_{1-5}$-alkyl)siloxanes (d).

6. The method of claim 5, wherein the polydi($C_{1-5}$-alkyl) siloxane (d) is hexamethyldisiloxane.

7. A method for providing a skin ski with improved performance on snow comprising applying a composition to a skin strip attached to a base of the skin ski, the said composition containing (a) at least one $C_{1-6}$-alcohol; and (b) at least one lubricant selected from a group consisting of (c) perfluoropolyethers, (d) polydi($C_{1-5}$-alkyl)siloxanes, and mixtures of (c) perfluoropolyethers and (d) polydi($C_{1-5}$-alkyl)siloxanes, said composition containing in at least 1% by weight of the total weight of the composition of (c) perfluoropolyethers.

8. A method of claim 1, wherein said composition contains at least 4% by weight of the total weight of the composition of (c) perfluoropolyethers.

9. A method of claim 1, wherein said composition contains at least 8% by weight of the total weight of the composition of (c) perfluoropolyethers.

10. The method of claim 1, wherein in said composition the amount of non-volatile perfluoropolyethers (c1) is at least at least 0.75% by weight of the total weight of said composition; and the amount of volatile perfluoropolyethers (c2) is at least 2% by weight of the total weight of said composition.

11. The method of claim 1, wherein in said composition the amount of non-volatile perfluoropolyethers (c1) is at least at least 1% by weight of the total weight of said composition; and the amount of volatile perfluoropolyethers (c2) is at least 5% by weight of the total weight of said composition.

12. The method of claim 1, wherein in said composition the amount of non-volatile perfluoropolyethers (c1) is at least 1% by weight of the total weight of said composition; and the amount of volatile perfluoropolyethers (c2) is at least 8% by weight of the total weight of said composition.

13. The method of claim 1, wherein said composition contains at least 20% by weight of the total weight of said composition of polydi($C_{1-5}$-alkyl)siloxanes (d).

14. The method of claim 1, wherein said composition contains at least 30% by weight of the total weight of said composition of polydi($C_{1-5}$-alkyl)siloxanes (d).

15. The method of claim 1, wherein said composition contains at least 40% by weight of the total weight of said composition of polydi($C_{1-5}$-alkyl)siloxanes (d).

16. A method of claim 7, wherein said composition contains at least 4% by weight of the total weight of the composition of (c) perfluoropolyethers.

17. A method of claim 7, wherein said composition contains at least 8% by weight of the total weight of the composition of (c) perfluoropolyethers.

* * * * *